US006024470A

United States Patent [19]

Wang

[11] Patent Number: 6,024,470

[45] Date of Patent: Feb. 15, 2000

[54] INTEGRATED FOLD-UP REFLECTOR BRACKETS

[75] Inventor: James P. Wang, Blacksburg, Va.

[73] Assignee: Hubbell Incorporated, Orange, Conn.

[21] Appl. No.: 09/090,069

[22] Filed: Jun. 3, 1998

[51] Int. Cl.[7] ..... F21V 17/06

[52] U.S. Cl. ..... 362/370; 362/368; 362/433

[58] Field of Search ..... 362/433, 453, 362/454, 350, 341, 362, 363, 368, 370, 404, 371, 396, 296, 343

[56] References Cited

FOREIGN PATENT DOCUMENTS 625688 9/1961 Italy ..... 362/370

*Primary Examiner*—Sandra O'Shea
*Assistant Examiner*—Marshall Honeyman
*Attorney, Agent, or Firm*—Jerry M. Presson; William C. Roch

[57] ABSTRACT

Integrated fold-up reflector mounting brackets to mount a reflector to a lighting fixture or luminaire are fabricated as an integral part of the reflector during the production thereof without the use of additional material, components and operations. The top of the reflector is fabricated with a stamping operation to provide an opening therein to provide for the mounting of a lamp socket and to allow for the flow of ventilation air therethrough. First and second fold-up mounting brackets are stamped and fabricated as an integral part of the top of the reflector. Each of the first and second fold-up brackets comprises a plurality of contoured ribs, with at least one of the contoured ribs having a truncation therein defined along a fold line for the mounting bracket. After fold-up of the mounting bracket along the fold line, the truncation is positioned against an other surface of the mounting bracket to enhance the rigidity of the deployed mounting bracket structure, and an opening is cleared in the top of the reflector.

20 Claims, 3 Drawing Sheets

INTEGRATED FOLD-UP REFLECTOR BRACKETS

BACKGROUND OF THE INVENTION

1. Field of the Invention

The present invention relates generally to integrated fold-up reflector mounting brackets to mount a reflector to a lighting fixture or luminaire, and more particularly pertains to integrated fold-up reflector mounting brackets which are fabricated as an integral part of the reflector of a lighting fixture or luminaire during the production thereof without the use of additional material, components and operations.

2. Discussion of the Prior Art

Reflectors are commonly mounted on or to a lighting fixture or luminaire by the use of additional mounting brackets which are secured to the reflector. Alternatively, the direct mounting of an inexpensive reflector without additional mounting brackets frequently causes thermal and optical problems, while additional bracket systems add parts, costs and installation steps to the resulting product.

SUMMARY OF THE INVENTION

Accordingly, it is a primary object of the present invention to provide integrated fold-up reflector brackets to mount a reflector to a lighting fixture or luminaire.

A further object of the subject invention is the provision of fold-up reflector brackets which are fabricated as an integral part of the reflector of a lighting fixture or luminaire during the production thereof without the use of additional material, components and operations, and which is particularly applicable to spun aluminum reflectors and plastic prismatic reflectors.

In accordance with the teachings herein, the present invention provides a reflector for a lighting fixture having first and second mounting brackets fabricated as an integral part of the top of the reflector. The top of the reflector is fabricated with a stamping operation to provide an opening in the top thereof to provide for the mounting of a lamp socket and to allow for the flow of ventilation air therethrough. First and second fold-up mounting brackets are stamped and fabricated as an integral part of the top of the reflector. Each of the first and second fold-up brackets comprises a plurality of contoured ribs, with at least one of the contoured ribs having a truncation therein defined along a fold line for the mounting bracket. After fold-up of the mounting bracket along the fold line, the truncation is positioned against an other surface of the mounting bracket to enhance the rigidity of the deployed mounting bracket structure, and an opening is cleared in the top of the reflector.

In greater detail, in a first embodiment the first and second mounting brackets are laid out in an offset S pattern wherein the first and second mounting brackets are positioned side by side across the top of the reflector. In a second embodiment the first and second mounting brackets are laid out in an opposed H pattern wherein the first and second mounting brackets each extend toward the center of the top of the reflector and each other.

In one embodiment, the top of the reflector is an integral part of the reflector, which is particularly applicable to reflectors spun from soft aluminum. In a second embodiment, the top of the reflector is a metal attaching system which is attached to the reflector, which is particularly applicable to plastic prismatic reflectors.

Each contoured rib is V shaped, and the truncation is positioned at a 45° angle relative to the longitudinal axis of the contoured rib. In one embodiment, after fold-up, the truncation is positioned flush against another contoured rib, and in a second embodiment the truncation is positioned flush against another truncation.

An access opening is provided adjacent to each fold-up mounting bracket to provide access to enable the bracket to be pryed to its fold-up position.

In a first embodiment, each mounting bracket comprises a plurality of parallel contoured ribs, and a further end contoured rib extends perpendicular to the ends of the parallel contoured ribs and provides the surface against which the truncations of the parallel ribs abut.

In a second embodiment, each mounting bracket comprises a first center contoured rib and a second contoured end rib laid out in a T pattern. The first center rib defines a truncated end surface adjacent to the center of the second end rib. After fold-up, the truncated end of the first center rib is seated flush against the center of the second rib to enhance the rigidity of the unfolded mounting bracket structure.

In one alternative embodiment, the fold-up line is formed by a pair of opposed truncations in each rib, and after fold-up, the opposed truncations are seated flush up against each other to enhance the rigidity of the unfolded mounting bracket structure.

The present invention also provides a method of fabricating first and second mounting brackets as an integral part of the fabrication of the top of a reflector for a lighting fixture. The top of the reflector is fabricated with a stamping operation to provide an opening in the top which provides for the mounting of a lamp socket therein and also allows for the flow of ventilation air therethrough. During the stamping operation, first and second fold-up mounting brackets are stamped and defined as an integral part of the top of the reflector. Each of the first and second fold-up mounting brackets comprises a plurality of contoured ribs, with at least one of the contoured ribs having a truncation defined along a fold line. After each bracket is folded-up along the fold line, the truncation is positioned flush against an other surface of the mounting bracket to enhance the rigidity of the deployed mounting bracket structure, and an opening is cleared in the top of the reflector.

In greater detail, the stamping operation defines the contoured ribs as V shaped ribs, and also provides a cut along the periphery of each mounting bracket. It also provides an access opening adjacent to each fold-up mounting bracket to allow the mounting bracket to be pryed to a fold-up position.

BRIEF DESCRIPTION OF THE DRAWINGS

The foregoing objects and advantages of the present invention for integrated fold-up reflector mounting brackets may be more readily understood by one skilled in the art with reference being had to the following detailed description of several preferred embodiments thereof, taken in conjunction with the accompanying drawings wherein like elements are designated by identical reference numerals throughout the several views, and in which.

DETAILED DESCRIPTION OF THE DRAWINGS

Figure 1:
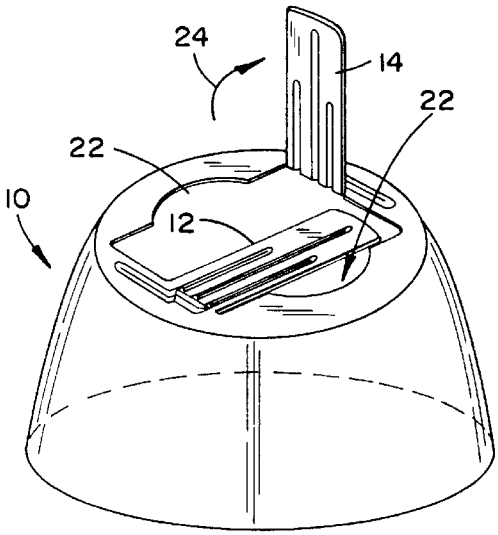
FIG. 1 illustrates a top perspective view of a reflector as used in a highbay fixture which is fabricated by being spun from very soft aluminum, and shows the integrated fold-up reflector mounting brackets of the present invention which are integrated into the fabrication of the top of the reflector.

The fabrication spun aluminum reflectors presently requires a secondary stamping operation in the top of the reflector to provide an opening in the top to enable the clearance of a lamp socket and lamp and to provide for ventilation. The present invention designs the reflector mounting brackets as an integral part of the top of the spun reflector which are fabricated during the secondary stamping operation, to in essence provide a "free" fabrication of the mounting brackets.

This technical approach can also be applied to plastic prismatic reflectors by incorporating the reflector mounting brackets into the metal attaching system which is attached to the top of each plastic reflector. In this instance, the reflector mounting brackets are designed to be fabricated as an integral part of the metal attaching system which is subsequently attached to the plastic prismatic reflector.

Two major problems are associated with this concept and had to be addressed:

1. Spun reflectors are made of very "soft" aluminum which makes poor and weak brackets. Moreover, since the customer normally assembles the luminaire on the ground prior to hanging thereof, the bracket system has to be strong enough to support the heavy ballast module in a "standing" position on the ground.
2. Various lamp sizes and light technologies require the reflectors to be located relatively far from the socket and to be adjustable in order to accommodate different light centers and distribution patterns. Additionally, the width at the top of the reflector is relatively small and represents a serious physical limitation.

There are two structural challenges associated with the first problem.

1. the brackets had relatively poor compression strength and bent easily, and
2. the connecting top surface would bend downwardly under the heavy ballast load.

Both of these problems were addressed by the present invention by designing a ribbing system into the mounting brackets and connecting top surface. In order to avoid using a weak, perforated scoring system on the fold-up mounting brackets, a unique truncated, rib design ensures folding at the desired location. The cross section of the ribs are "V-shaped" and the truncations are positioned along the bend line location. The truncations are 45 degrees, and in the fold-up configuration are seated flush up against an end V-shaped rib or up against each other to reinforce the overall strength of the system in its fold-up configuration.

The second problem was addressed with two different design approaches:

1. In a first embodiment, the mounting brackets are laid out in an off-set "S" pattern to achieve the required length in the brackets to accommodate a vertical adjustment of the reflector. This approach was designed to be used with a narrow, vertical wall housing wherein the mounting brackets can be adjusted up and down the side walls.
2. In a second embodiment, the mounting brackets are laid out in an opposed "H" pattern, and are used in conjunction with a separate additional bracket to achieve the required length and adjustability. The additional bracket is required for two bracket systems wherein there is not enough room above the top brackets to allow them to be adjusted upwardly. Adjustments are achieved by linearly displacing one mounting bracket relative to the second bracket.

Both fold-up designs provide void areas adjacent to the mounting brackets to allow fingers to be inserted under the brackets to fold them up to their deployed positions. Either design approach is less expensive, requires less parts, and is easier to install (mounting bracket attachment to the reflector is eliminated) than prior art mounting bracket systems it would replace. Additionally, since the mounting bracket system is folded-up to a deployed position by the customer, bulk package nesting is not affected.

Figure 4:
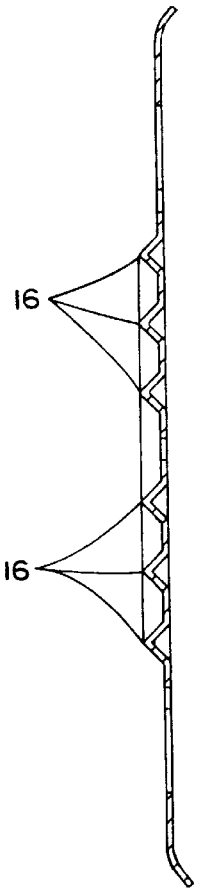
FIGS. 3 and 4 are sectional views taken through the mounting brackets of FIG. 2, taken respectively along directional arrows 3—3 and 4—4 in FIG. 2.

FIG. 1 illustrates a top perspective view of a reflector 10 as used in a highbay fixture which is fabricated by being spun from very soft aluminum, and shows the integrated fold-up mounting brackets 12, 14 pursuant to the teachings of the present invention. FIGS. 3 and 4 are sectional views taken through the mounting brackets of FIG. 2, taken respectively along directional arrows 3—3 and 4—4 in FIG. 2.

The mounting brackets of FIG. 1 are laid out in an offset S pattern. A first of the mounting is brackets 12 is illustrated in the position in which it is fabricated during the secondary stamping operation, while the second of the mounting brackets 14 is illustrated in its deployed, fold-up position. Each of the first and second fold-up mounting brackets has a plurality of V shaped ribs 16 with truncations 18 being defined in each rib at a bend-up location or line 20. A finger access depression 22 is defined adjacent to each mounting bracket to enable an installer to pry up each mounting bracket to its fold-up deployed position, with each bracket pivoting along its respective truncated fold line 20, as illustrated by the fold-up arrow 24 of FIG. 1. After folding and deployment, the triangular truncated surfaces 18 come into direct contact with an end V shaped rib 26 to enhance the rigidity of the deployed assembly.

Figure 5:
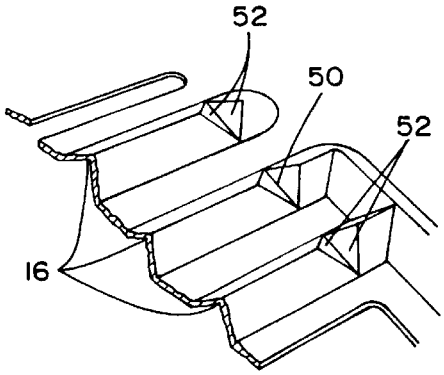
FIG. 5 is a top perspective view of a modification of the structure of FIG. 2.
Figure 2:
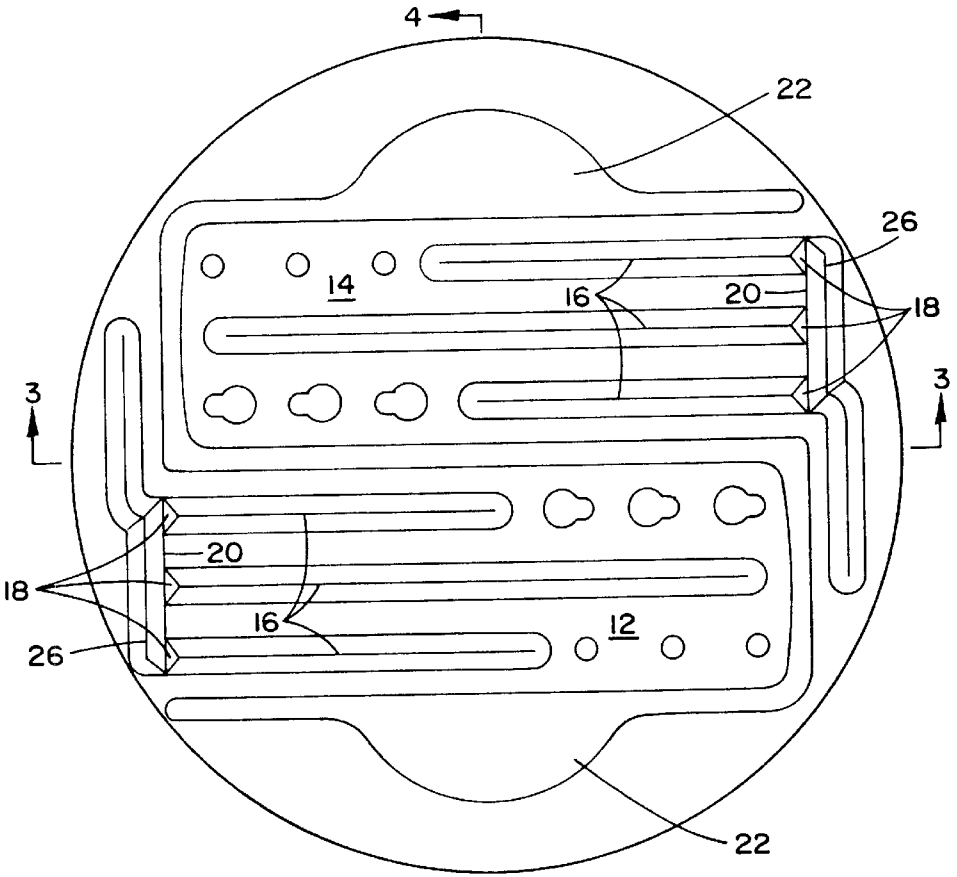
FIG. 2 is an enlarged view of the integrated fold-up reflector mounting brackets of FIG. 1.
Figure 3:
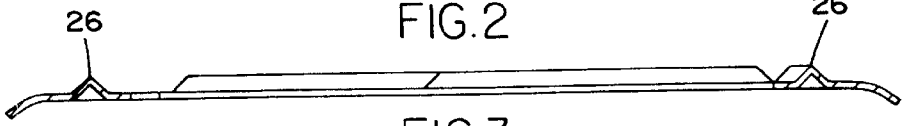

FIG. 5 is a top perspective view of a modification of the structure of FIG. 2 in which a fold-up line 50 is formed by a pair of opposed truncations 52 in each rib, such that in the fold-up configuration, the opposed truncations 52 are seated flush up against each other to reinforce the strength of the structure.

Figure 6:
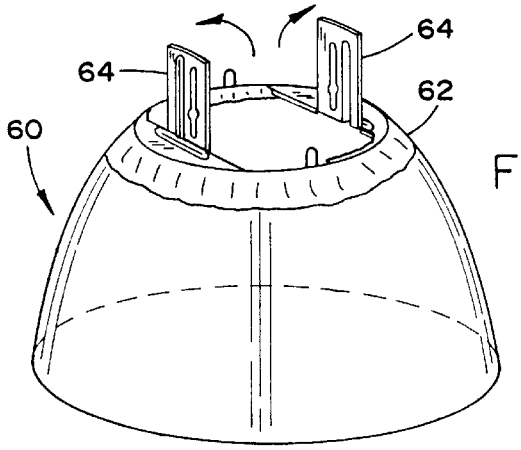
FIGS. 6 and 8 illustrate a further embodiment of the present invention wherein the two fold-up reflector mounting brackets are arranged in an opposed H pattern.
Figure 7:
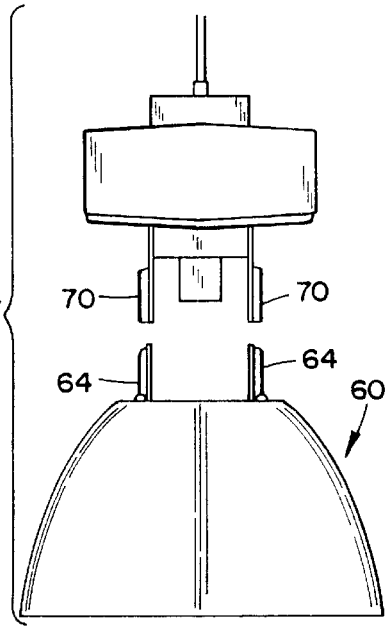
FIG. 7 illustrates the fold-up mounting brackets of the reflector of FIGS. 6 and 8 cooperating with and being received by a top bracket of a lighting fixture, to provide a required adjustment in length.
Figure 8:
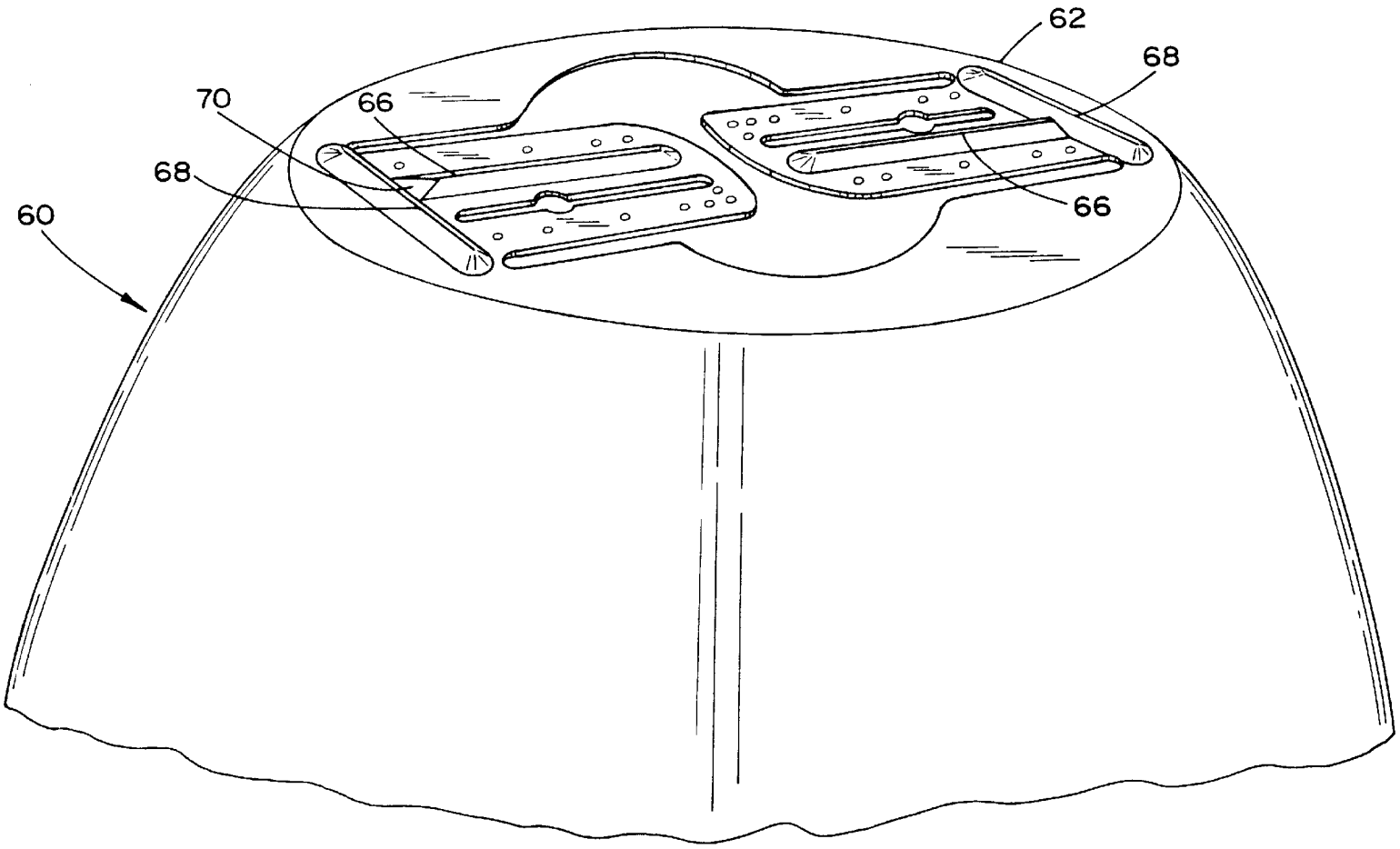

FIGS. 6 through 8 illustrate a further embodiment of the present invention wherein the reflector comprises a plastic prismatic reflector 60 having a top metal attachment 62 secured to the top of the plastic prismatic reflector 60, and the mounting brackets 64 are formed as an integral part of the top metal attachment 62. In this embodiment, the two mounting brackets 64 are arranged in an opposed H pattern. As illustrated in FIG. 8, each mounting bracket 64 is formed by first and second V shaped ribs 66, 68 which are arranged in a T shape relative to each other. The first center V shaped rib 66 defines a truncated 45° end surface 70 adjacent to the center of the second rib 68, such that after each mounting bracket is folded into an upright position, as illustrated in FIG. 6, the truncated end 70 of the first center rib 66 rests flush against the center of the second rib 68 to enhance the rigidity of the unfolded mounting bracket structure.

As illustrated in FIG. 7, each fold-up mounting bracket 64 of the reflector of FIGS. 6 and 8 cooperates with and is received by a corresponding top bracket 70 of the lighting fixture, to provide a required adjustment in length, wherein the adjustment is achieved by linearly sliding each lower mounting bracket 64 relative to each top bracket 70.

While several embodiments and variations of the present invention for integrated fold-up reflector mounting brackets are described in detail herein, it should be apparent that the disclosure and teachings of the present invention will suggest many alternative designs to those skilled in the art.

What is claimed is:

1. A reflector for a lighting fixture having first and second mounting brackets fabricated as an integral part of the top of the reflector, comprising:

a. a reflector for a lighting fixture, wherein the top of the reflector is fabricated with a stamping operation to provide an opening in the top of the reflector to provide for the clearance of a lamp socket and lamp and to allow for the flow of ventilation air therethrough;

b. first and second fold-up mounting brackets stamped and fabricated as an integral part of the top of the reflector, with each of the first and second fold-up brackets comprising a plurality of contoured ribs, with at least one of the contoured ribs having a truncation therein defined along a fold line for the mounting bracket, and wherein after fold-up of the mounting bracket along the fold line, the truncation is positioned against an other surface of the mounting bracket to enhance the rigidity of the deployed structure and an opening is cleared in the top of the reflector.

2. A reflector for a lighting fixture as claimed in claim 1, wherein the first and second mounting brackets are laid out in an offset S pattern, wherein the first and second mounting brackets are positioned side by side across the top of the reflector.

3. A reflector for a lighting fixture as claimed in claim 1, wherein the first and second mounting brackets are laid out in an opposed H pattern, wherein the first and second mounting brackets each extend toward the center of the top of the reflector and each other.

4. A reflector for a lighting fixture as claimed in claim 1, wherein the top of the reflector is an integral part of the reflector.

5. A reflector for a lighting fixture as claimed in claim 4, wherein the reflector is spun from soft aluminum.

6. A reflector for a lighting fixture as claimed in claim 1, wherein the top of the reflector is a metal attaching system which is attached to the reflector.

7. A reflector for a lighting fixture as claimed in claim 6, wherein the reflector is a plastic prismatic reflector.

8. A reflector for a lighting fixture as claimed in claim 1, wherein each contoured rib is V shaped.

9. A reflector for a lighting fixture as claimed in claim 1, wherein the truncation is positioned at a 45° angle relative to a longitudinal direction of the contoured rib.

10. A reflector for a lighting fixture as claimed in claim 1, wherein after fold-up, the truncation is positioned flush against another contoured rib.

11. A reflector for a lighting fixture as claimed in claim 1, wherein after fold-up, the truncation is positioned against another truncation.

12. A reflector for a lighting fixture as claimed in claim 1, wherein an access opening is provided adjacent to each fold-up mounting bracket to provide access to enable the bracket to be pryed to a fold-up position.

13. A reflector for a lighting fixture as claimed in claim 1, comprising a plurality of parallel contoured ribs, and a further end contoured rib extending perpendicular to the ends of the parallel contoured ribs which provides said other surface of the mounting bracket.

14. A reflector for a lighting fixture as claimed in claim 1, comprising a first center contoured rib and a second contoured end rib laid out in a T pattern, wherein the first center rib defines a truncated end surface adjacent to the center of the second end rib, such that after fold-up, the truncated end of the first center rib is seated flush against the center of the second rib to enhance the rigidity of the unfolded mounting bracket structure.

15. A reflector for a lighting fixture as claimed in claim 1, wherein the fold-up line is formed by a pair of opposed truncations in each rib, and after fold-up, the opposed truncations are seated flush up against each other to enhance the rigidity of the unfolded mounting bracket structure.

16. A method of fabricating first and second mounting brackets as an integral part of the fabrication of the top of a reflector for a lighting fixture comprising:

a. fabricating the top of the reflector for the lighting fixture with a stamping operation to provide an opening in the top of the reflector to provide for the clearance of a lamp socket and lamp therein and to allow for the flow of ventilation air therethrough;

b. during the stamping operation, stamping and defining first and second fold-up mounting brackets as an integral part of the top of the reflector, with each of the first and second fold-up mounting brackets comprising a plurality of contoured ribs, with at least one of the contoured ribs having a truncation defined along a fold line, and wherein after each bracket is folded-up along the fold line, the truncation is positioned flush against an other surface of the mounting bracket to enhance the rigidity of the deployed mounting bracket structure, and an opening is cleared in the top of the reflector.

17. A reflector for a lighting fixture as claimed in claim 16, wherein the first and second mounting brackets are laid out in an offset S pattern wherein the first and second mounting brackets are positioned side by side across the top of the reflector.

18. A reflector for a lighting fixture as claimed in claim 16, wherein the first and second mounting brackets are laid out in an opposed H pattern wherein the first and second mounting brackets each extend toward the center of the top of the reflector and each other.

19. A reflector for a lighting fixture as claimed in claim 16, wherein the stamping operation defines the contoured ribs as V shaped ribs.

20. A reflector for a lighting fixture as claimed in claim 16, wherein the stamping operation provides a cut along the periphery of each mounting bracket and also provides an access opening adjacent to each fold-up mounting bracket to allow the mounting bracket to be pryed to a fold-up position.

* * * * *